US008737907B2

(12) United States Patent
Hatazaki

(10) Patent No.: US 8,737,907 B2
(45) Date of Patent: May 27, 2014

(54) IMAGE FORMING APPARATUS

(75) Inventor: Kazunari Hatazaki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 13/642,401

(22) PCT Filed: May 24, 2011

(86) PCT No.: PCT/JP2011/002887

§ 371 (c)(1),
(2), (4) Date: Oct. 19, 2012

(87) PCT Pub. No.: WO2012/001875

PCT Pub. Date: Jan. 5, 2012

(65) Prior Publication Data

US 2013/0039684 A1 Feb. 14, 2013

(30) Foreign Application Priority Data

Jul. 1, 2010 (JP) ..... 2010-150771

(51) Int. Cl.
*G03G 21/20* (2006.01)
*G03G 15/00* (2006.01)

(52) U.S. Cl.
CPC ..... *G03G 15/6582* (2013.01); *G03G 15/6576* (2013.01)
USPC ..... 399/407; 399/406; 399/341

(58) Field of Classification Search
CPC ..... G03G 15/6582; G03G 15/6576; G03G 15/6573
USPC ..... 399/341, 406, 407
See application file for complete search history.

(56) References Cited

U.S. PATENT DOCUMENTS

| | | | | |
|---|---|---|---|---|
| 4,110,155 | A * | 8/1978 | Minagawa et al. | 162/135 |
| 5,842,105 | A | 11/1998 | Acquaviva | |
| 5,850,589 | A | 12/1998 | Cruz et al. | |
| 6,363,238 | B1 | 3/2002 | Spencer et al. | |
| 8,472,859 | B2 * | 6/2013 | Kougami | 399/407 |
| 2007/0048357 | A1 | 3/2007 | Shannon | |
| 2010/0284717 | A1 * | 11/2010 | Shida | 399/341 |
| 2012/0114402 | A1 | 5/2012 | Hatazaki | |

FOREIGN PATENT DOCUMENTS

| | | | |
|---|---|---|---|
| JP | 60104982 | A * | 6/1985 |
| JP | 11-167317 | A | 6/1999 |

* cited by examiner

*Primary Examiner* — Clayton E Laballe
*Assistant Examiner* — Leon W Rhodes, Jr.
(74) *Attorney, Agent, or Firm* — Fitzpatrick, Cella, Harper & Scinto

(57) ABSTRACT

An image forming apparatus which prevents evaporation of moisture applied to a sheet by virtue of an aqueous solution containing a deliquescent material, and maintains a state in which curling or wavelike distortions are reduced. The structure of the image forming apparatus is characterized by including an image forming parts that forms toner images on paper sheets, and a fixing device which thermally fixes a toner image onto a sheet, and an aqueous solution applying portion which applies an aqueous solution to the sheet, the aqueous solution applying portion applies the aqueous solution containing a deliquescent material which prevents moisture evaporation to a sheet having a toner image thermally fixed thereonto by a fixing device.

10 Claims, 3 Drawing Sheets

IMAGE FORMING APPARATUS

BACKGROUND OF THE INVENTION

1. Field of the Invention

The present invention relates to a technique for reducing wavelike distortions or curling of sheets by applying moisture or an aqueous solution to the sheets in an image forming apparatus utilizing an electrophotographic system.

2. Description of the Related Art

Conventionally, an image forming apparatus utilizing an electrophotographic system develops a latent image formed on a photosensitive drum serving as an image bearing member, to visualize an image. The image forming apparatus transfers the visualized image (a toner image) onto a sheet, using an electrostatic force. The transferred image is then thermally fixed, so that the image is formed on the sheet.

In image forming apparatuses such as electrophotographic apparatuses and electrostatic recording apparatuses, a toner image is formed on a sheet, and heat and pressure are applied onto the toner image, so as to fix the toner image. In this manner, an image is formed. As the fixing device which performs such operations, there has been a roller fixing system which presses a pressure roller against a heater-containing fixing roller to form a fixing nip portion, and performs image fixing.

In the fixing devices provided in image forming apparatuses such as copying machines utilizing electrophotographic systems, thermal-roller fixing devices have been often used to fix a toner image onto a sheet.

A fixing device utilizing thermal roller system guides a sheet into a pressing nip portion (a fixing nip portion) that is formed by a fixing roller heated by a built-in heat source such as a halogen heater and maintained at a predetermined temperature, and a pressure roller that is pressed against the fixing roller and has elasticity. The fixing device nips and conveys the sheet. An unfixed toner image on the surface of the sheet is then thermally fixed. Since heat and pressure are applied onto the toner and the sheet in this process, the moisture in the sheet evaporates while the sheet is being pressed.

Due to variation in the amount of moisture in the sheet and the stress applied to the sheet, wavelike distortions and curling appear in the sheet. When a paper sheet is observed in terms of fiber, paper is formed by short fibers that are tangled up, and moisture exists in or between the fibers. Therefore, the fibers and the moisture form hydrogen bonding.

When heat and pressure are applied onto a paper sheet in an image fixing process, the fibers deviate from one another due to the pressure. As the paper sheet is heated, and moisture evaporates, hydrogen bonding occurs between the fibers, resulting in deformation of the sheet. If the paper is left, the paper absorbs moisture from the surroundings, and the hydrogen bonding between the fibers is again broken. However, moisture does not reach some of the fibers, and the deformation of the sheet remains. Deformation may be caused by the difference in expansion and contraction rates between the front and back surfaces of a paper sheet, or may be caused by the difference in expansion and contraction rates between the center portion and each end portion of a paper sheet. Such deformation leads to wavelike distortions or curling of the sheet.

Japanese Patent Laid-Open No. 11-167317 discusses a solution to the above problem. The technique according to Japanese Patent Laid-Open No. 11-167317 concerns a device and system used in electrostatic copying machines. This device and system prevent formation of curling and wavelike distortions at the edges of paper sheets for copiers due to evaporation of moisture from the paper sheets in electrostatic copying or printing fixing steps. This device includes a water-jet unit that applies a controlled amount of moisture to one of or both of the surfaces of a copy sheet. The water-jet unit is positioned on both surface sides of the copy sheet, and has a reservoir for holding liquid. This device also includes a pair of pressure rollers each having a cylindrical external surface. The pair of pressure rollers are positioned to face each other along the shafts thereof, so that a nip portion can be secured between the cylindrical external surfaces. This device further includes a control device that controls the amount of moisture to be applied from the water-jet unit to a selected portion of each sheet passing through this device, before the sheet enters the nip portion formed between the cylindrical external surfaces. The amount of moisture in each sheet decreases after the sheet passes through the fixing device, and curling and wavelike distortions appear in the sheet. To counter this phenomenon, moisture is applied to the sheet after the fixing, and the lost moisture is compensated for. In this manner, curling and wavelike distortions are made smaller.

By applying moisture to paper, the moisture having evaporated due to the heat and pressure in the image fixing process is compensated for, and wavelike distortions and curling are corrected. As the amount of moisture in paper becomes larger, the Young's modulus of the paper becomes lower. The stiffness of the paper then becomes lower, and the wavelike distortions become smaller. It is also believed that, when moisture enters spaces between fibers, the bonding between the fibers having formed the hydrogen bonding is again broken by the fixing device, and accordingly, wavelike distortions become smaller.

By the technique discussed in Japanese Patent Laid-Open No. 11-167317, curling or wavelike distortions of sheets are temporarily reduced by applying moisture to the paper sheets. However, as the applied moisture evaporates and the sheets become dry, the curling or wavelike distortions of the sheets again increase.

SUMMARY OF THE INVENTION

A typical image forming apparatus according to the present invention to solve the above problems includes an image forming unit which forms a toner image on a sheet; a fixing unit which thermally fixes a toner image onto a sheet; and an aqueous solution applying unit which applies an aqueous solution to the sheet, the aqueous solution applying unit applies the aqueous solution containing a deliquescent material which prevents moisture evaporation to a sheet having a toner image thermally fixed thereonto by a fixing unit.

With the above-described structure, by applying an aqueous solution containing a deliquescent material to a sheet, the applied moisture is prevented from evaporating, and the reduction of curling or wavelike distortions can be continued.

Further features of the present invention will become apparent from the following description of exemplary embodiments with reference to the attached drawings.

DESCRIPTION OF THE EMBODIMENTS

Figure 1:
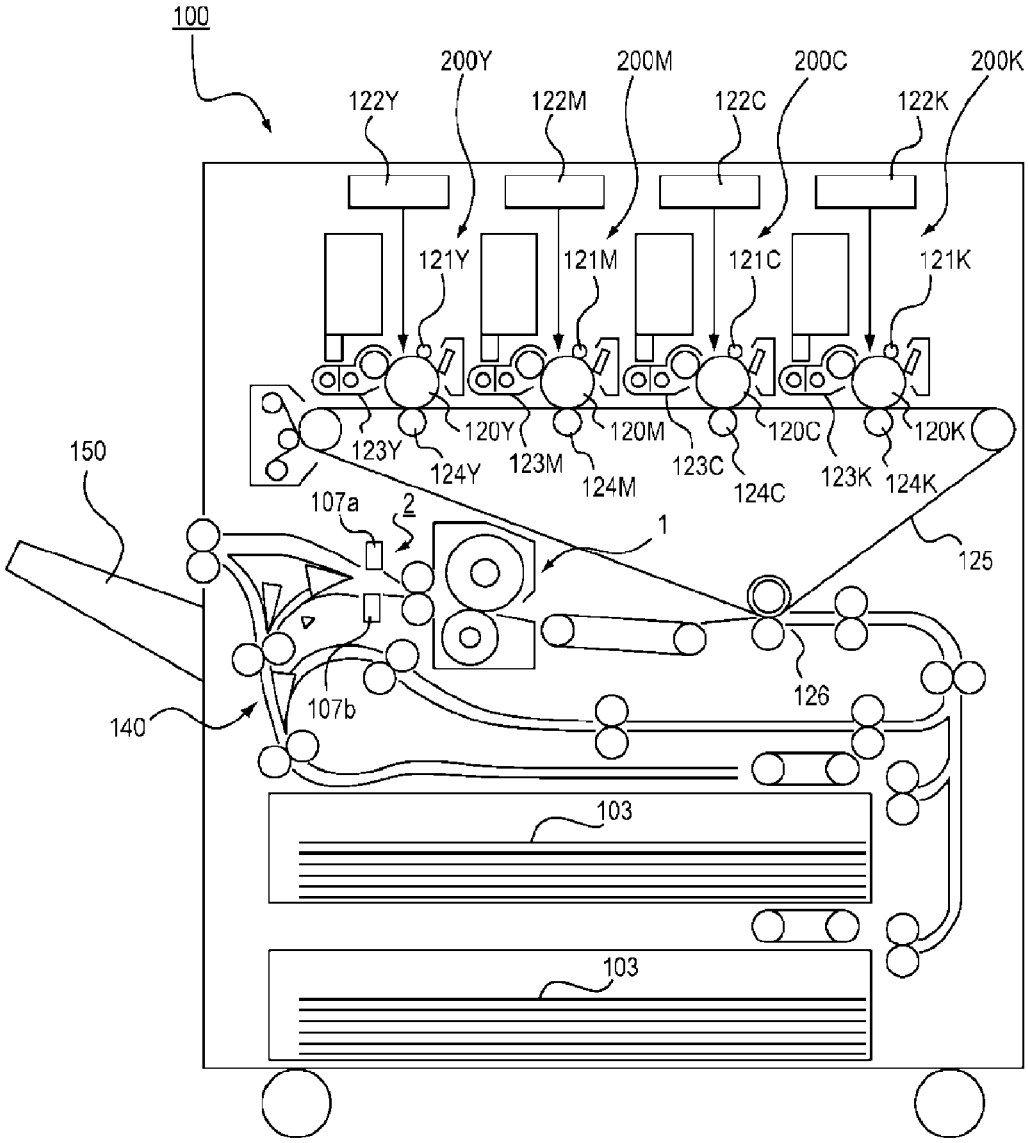
FIG. 1 is a schematic diagram illustrating the structure of an image forming apparatus according to the present invention.

Referring first to FIG. 1, the structure of an image forming apparatus according to the present invention is described. FIG. 1 illustrates an image forming apparatus of a full-color intermediate transfer type as a specific example of an image forming apparatus according to the present embodiment. The apparatus main body 100 of the image forming apparatus in this example includes an image forming unit that forms toner images on paper sheets 103. This image forming unit is formed by arranging image forming parts 200Y, 200M, 200C, and 200K in series, for example. The image forming parts 200Y, 200M, 200C, and 200K correspond to the respective colors of Y (yellow), M (magenta), C (cyan), and K (black).

That is, the image forming apparatus illustrated in FIG. 1 is an image forming apparatus that employs a tandem system that performs parallel processing with the respective colors until the end of the image visualizing process. In the following, for simplicity of description, an image forming part 200 represents the four image forming parts 200Y, 200M, 200C, and 200K of the colors Y, M, C, and K, and the same applies to the relevant processing units described below. Also, the arrangement sequence of the image forming parts of the respective colors of Y, M, C, and K is not limited to that. It should be noted that the embodiments are not limited to image forming apparatuses of the full-color intermediate transfer type, but may be applied to monochrome image forming apparatuses.

Each image forming part 200 includes the following processing units. Image bearing members 120Y, 120M, 120C, and 120K that bear electrostatic latent images on the surfaces thereof, and primary charging devices 121Y, 121M, 121C, and 121K are provided to cope with the respective colors Y, M, C, and K. Further, exposure devices 122Y, 122M, 122C, and 122K, and development devices 123Y, 123M, 123C, and 123K are provided. Each primary charging device 121 uniformly charges the surface of the corresponding image bearing member 120 by applying a charging bias voltage having a predetermined potential to the surface of the corresponding image bearing member 120. The corresponding exposure device 122 exposes the surface, and an electrostatic latent image is formed. The electrostatic latent image is then developed with toner by the corresponding development device 123, and is turned into a visible image as a toner image.

The toner images formed and borne on the surfaces of the image bearing members 120 are sequentially stacked on an intermediate transfer member 125 formed with an endless belt, by primary transfer devices 124Y, 124M, 124C, and 124K. In this manner, the primary transfer is performed. The toner image on the intermediate transfer member 125 onto which all the colors Y, M, C, and K have been transferred is then collectively secondary-transferred onto a sheet 103 by a secondary transfer device 126. The sheet 103 bearing the transferred toner image is then transported to a fixing device 1 that includes a fixing unit that thermally fixes the toner image onto the image-bearing sheet 103.

The fixing device 1 nips a sheet 103 at a fixing nip portion, and applies heat and pressure onto an unfixed toner image on the sheet 103. By doing so, the fixing device 1 fixes the toner image onto the sheet 103. Injection nozzles 107*a* and 107*b* of an aqueous solution applying portion 2 to serve as an aqueous solution applying unit that, after the sheet 103 passes through the fixing device 1, applies an aqueous solution containing a deliquescent material that prevents moisture evaporation to the sheet 103 having the toner image thermally fixed thereto by the fixing device 1 are provided on the front and back surface sides of the sheet 103. Before the sheet 103 is dried by the fixing unit of the fixing device 1, and the amount of moisture in the sheet 103 again becomes equivalent to the amount of moisture in the surroundings, the aqueous solution applying portion 2 applies an aqueous solution 109 containing a deliquescent material to both surfaces or one surface of the sheet 103. After that, the sheet 103 is conveyed onto a discharge tray 150 of the apparatus main body 100 or to a duplex sheet conveying path 140.

In the above-described manner, a series of image forming processes such as charging, exposure, development, transfer, and fixing are performed in the apparatus main body 100, to form a color toner image on the sheet 103, which is then discharged onto the discharge tray 150. Where the apparatus is a monochrome image forming apparatus, there is only the image bearing member 120K of black (K), and a toner image formed on the image bearing member 120K is transferred onto a sheet 103 by the primary transfer device 124K.

Figure 2:
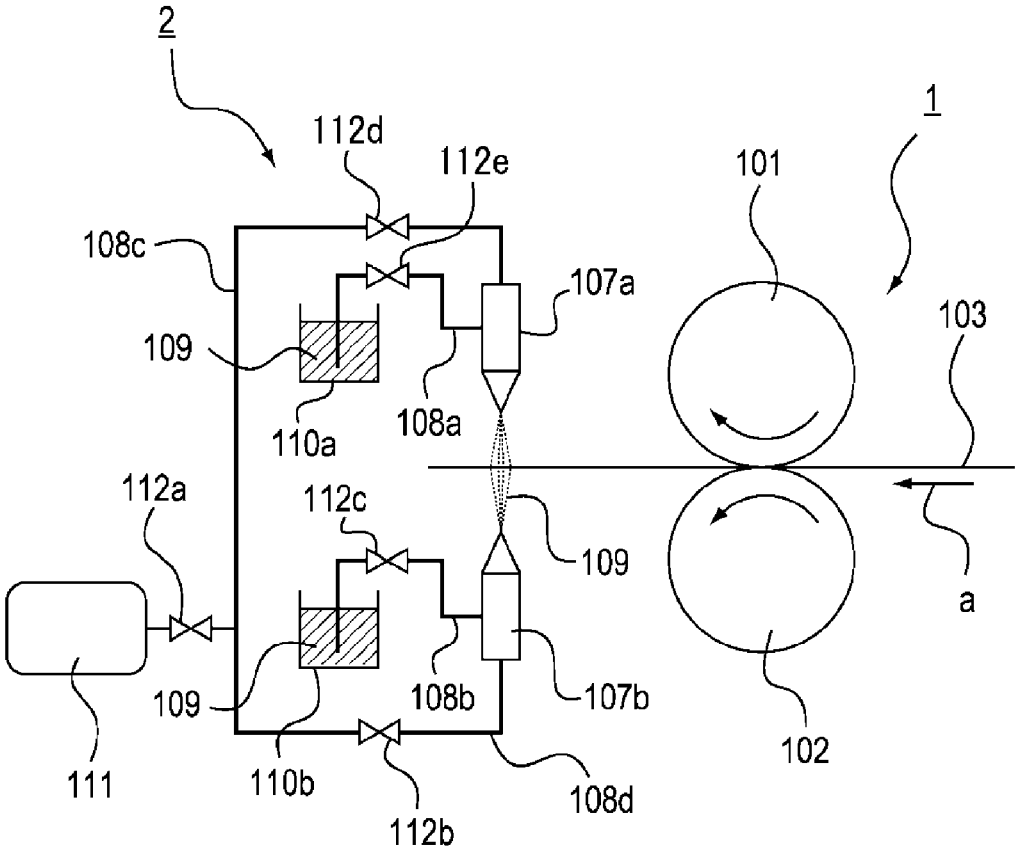
FIG. 2 is a schematic view of an embodiment of the aqueous solution applying unit that applies an aqueous solution containing a deliquescent material to a sheet.

FIG. 2 is a schematic cross-sectional view illustrating a specific structure of the aqueous solution applying portion 2 that applies the aqueous solution 109 containing a deliquescent material to a paper sheet 103. In FIG. 2, the fixing unit provided in the fixing device 1 includes a fixing rotating member 101 having a heating unit, and a pressurizing rotating member 102 that is pressed against the fixing rotating member 101. The two rotating members of the fixing rotating member 101 and the pressurizing rotating member 102 heat and pressurize an unfixed toner image on the sheet 103, to perform image fixing. After the sheet 103 passes through the fixing device 1, the aqueous solution 109 containing a deliquescent material is sprayed onto the sheet 103. In FIG. 2, arrow "a" indicates the conveying direction of the sheet 103.

Where the injection nozzles 107*a* and 107*b* provided in the aqueous solution applying part 2 are used, the two injection nozzles 107*a* and 107*b* for spraying the aqueous solution 109 containing a deliquescent material are positioned on the front and back surface sides of the sheet 103. A compressor 111 for supplying compressed air to the injection nozzles 107*a* and 107*b* is also provided. Tanks 110*a* and 110*b* for supplying the aqueous solution 109 containing a deliquescent material to the injection nozzles 107*a* and 107*b* are also provided. Tubes 108*a* through 108*d* for supplying the compressed air supplied from the compressor 111 and the aqueous solution 109 supplied from the tanks 110*a* and 110*b* to the respective injection nozzles 107*a* and 107*b* are also provided. Valves 112*a* through 112*e* for starting and stopping the supplies of the compressed air and the aqueous solution 109 are provided. With the use of retainers (not illustrated), the two injection nozzles 107*a* and 107*b* are installed in the sheet conveying path, after the sheet 103 passes through the fixing device 1 and the toner image is fixed onto the sheet 103. Both of or one of the two injection nozzles 107*a* and 107*b* then sprays the aqueous solution 109 onto the paper sheet 103. In this manner, the aqueous solution 109 is sprayed onto the sheet 103 after the sheet 103 passes through the fixing device 1. The injection nozzles 107*a* and 107*b* are positioned on the front and back surface sides of the sheet 103 in the sheet conveying path, and apply the solution to both surfaces or one surface of the sheet 103.

The aqueous solution 109 to be sprayed onto the paper sheet 103 contains a deliquescent material and a surfactant for increasing permeability for the sheet 103. By virtue of the permeability of the surfactant, the aqueous solution 109 containing a deliquescent material can easily penetrate into the fiber of the sheet 103 made of paper. As a result, the effect to break the hydrogen bonding in the fiber of paper and dissolve cellulose is increased, and wavelike distortions or curling of the sheet 103 is made smaller. Also, as the permeability is increased by the addition of the surfactant, the stickiness between sheets 103 stacked on one another can be reduced.

Here, "deliquescence" is a phenomenon where a substance absorbs moisture from the air, forming an aqueous solution. When the concentration of the aqueous solution reaches a certain value, the substance stops absorbing moisture. The moisture in the air is absorbed by a deliquescent material, and a saturated aqueous solution is formed. The amount of material in crystals is sufficiently large, and therefore, crystals do not melt away even if the crystals are dissolved in some water. Accordingly, the amount of saturated aqueous solution continues to increase, and the saturated aqueous solution continues to become thinner until all the crystals are dissolved and the water vapor pressure of the aqueous solution becomes equal to the water vapor pressure in the atmosphere. The moisture absorption stops only when the water vapor pressure in the atmosphere and the water vapor pressure in the aqueous solution become equivalent to each other.

Also, a solution containing a nonvolatile substance that forms hydrogen bonding with the fiber of paper, instead of moisture, and restrains hydrogen bonding in the fiber is applied to each sheet 103. The solution then penetrates into the fiber, and prevents hydrogen bonding in the fiber, though the sheet 103 becomes dry. Accordingly, the reduction of wavelike distortions or curling of the sheets 103 can be continued.

The aqueous solution 109 of the present embodiment contains a surfactant. Surfactants are compounds that characteristically contain both hydrophilic groups and hydrophobic groups. Surfactants form micelle, vesicle, or lamella structures, evenly mixing polar substances and nonpolar substances. Surfactants also reduce surface tension.

As a surfactant is mixed into the aqueous solution 109, the permeability becomes higher. As a result, the aqueous solution 109 easily penetrates into the fiber of paper, and the effect to break the hydrogen bonding in the fiber of paper and dissolve cellulose is increased. Accordingly, wavelike distortions or curling of the sheets 103 is made smaller. If only water is applied, the permeability in the sheets 103 is low, and water droplets remain on the surfaces of the sheets 103. When a large number of sheets 103 are stacked, the sheets 103 stick to one another. However, by mixing a surfactant into the aqueous solution 109, the permeability in the sheets 103 is made higher, and the stacking characteristics of the sheets 103 are improved.

In the present embodiment, the injection nozzles 107*a* and 107*b* are used as the mechanism to apply the aqueous solution 109 to each sheet 103. Other examples of mechanisms that apply the aqueous solution 109 to each sheet 103 include various mechanisms such as a water-jet mechanism and a mechanism utilizing an applying roller. The mechanism that applies the aqueous solution 109 containing a deliquescent material to each sheet 103 is not limited to the injection nozzles 107*a* and 107*b*.

With the use of the aqueous solution applying portion 2 illustrated in FIG. 2, only water was sprayed onto a sheet 103 which had just passed through the fixing device 1. The amount of moisture sprayed or the amount of moisture applied to sheets 103 was varied, and wavelike distortions appearing in the sheets 103 were measured. The paper used therein was CLC 80 g of size A3 and fiber orientation CD (manufactured by Canon Inc.). The image was solid white, and one-side feeding was performed. The temperature in the surroundings was approximately 23° C., and the humidity was approximately 40%. Here, the temperature of the fixing rotating member 101 in the fixing device 1 was 170° C., and the rotation speed was 300 mm/sec. The temperature of the pressurizing rotating member 102 was 100° C., and the rotation speed was 300 mm/sec. Accordingly, the speed of each sheet 103 passing through the injection nozzles 107*a* and 107*b* of the aqueous solution applying portion 2 was 300 mm/sec. The results of the measurements are shown in Table 1.

TABLE 1

| amount [%] of moisture in sheet immediately after spraying | elapsed time [h] | height of wavelike distortions [mm] |
|---|---|---|
| 3.5 | 0 | 4.6 |
| | 48 | 3.8 |
| 5 | 0 | 2.3 |
| | 48 | 3.3 |
| 5.4 | 0 | 2.2 |
| | 48 | 4.5 |
| 5.7 | 0 | 2.0 |
| | 48 | 3.1 |
| 7.9 | 0 | 1.7 |
| | 48 | 5.5 |
| 8.3 | 0 | 1.6 |
| | 48 | 8.0 |

As shown in Table 1, the height of wavelike distortions of each paper sheet 103 onto which water was sprayed with the use of the injection nozzles 107*a* and 107*b* immediately after passing through the fixing device 1 is smaller than the height of wavelike distortions of each sheet 103 onto which water was not sprayed immediately after passing through the fixing device 1. As the amount of water to be applied to the sheets 103 is increased, the wavelike distortions of each sheet 103 having a larger amount of moisture tend to be smaller immediately after the addition of moisture. When the amount of moisture in the paper and the amount of moisture in the surroundings become equivalent to each other after forty-eight hours since the spraying, the wavelike distortions of each sheet 103 having a larger amount of water sprayed thereto tend to be larger. This is supposedly because the moisture evenly sprayed onto the paper evaporated unevenly over time.

With the above measurement results being taken into account, it is thought that a distortion-reduced state is maintained, if the amount of moisture held immediately after the spraying of moisture can be maintained. Therefore, the aqueous solution 109 containing a deliquescent material is used.

A deliquescent material absorbs moisture from the air, forming the aqueous solution 109. The deliquescent material continues to absorb moisture until the concentration of the aqueous solution 109 reaches a certain value. A deliquescent material is mixed with water to form the aqueous solution 109, which is sprayed onto each sheet 103 to apply moisture to each sheet 103. Accordingly, while wavelike distortions and curling are reduced, the applied moisture is maintained in each sheet 103.

Figure 3A:
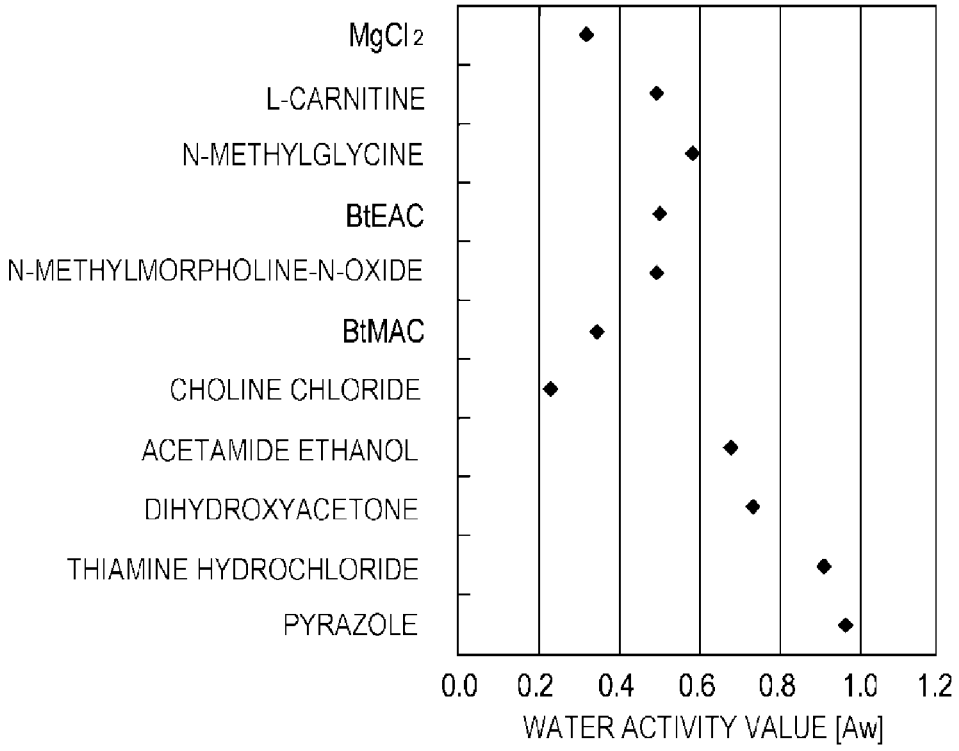
FIG. 3A is a graph illustrating the water activity values of deliquescent materials.

Examples of deliquescent materials that can be used are illustrated in FIG. 3A. The water retention ability of each of the deliquescent materials is evaluated by means of the water activity value. As the water activity value becomes smaller, the water retaining effect becomes larger. Each deliquescent material having a water activity value of 0.6 or lower among those deliquescent materials is particularly effective in reducing wavelike distortions and curling of the sheets 103. As illustrated in FIG. 3A, examples of deliquescent materials having water activity values of 0.6 or lower include magnesium chloride ($MgCl_2$), L-carnitine, and N-methylglycine. Examples of such materials further include BtEAC (benzyltriethylammonium chloride), N-methylmorpholine-N-oxide (MMNO), BtMAC (benzyltrimethylammonium chloride), and choline chloride.

The above-described deliquescent materials were applied to the sheets 103, and the variations of the amounts of moisture were checked. The injection nozzles 107*a* and 107*b* of the aqueous solution applying portion 2 illustrated in FIG. 2 were used as the mechanism to apply the aqueous solution 109 containing a deliquescent material. Here, a 50% solution of choline chloride was used as a deliquescent material. The results of the measurements are shown in Table 2.

TABLE 2 amount of moisture in sheet after 24 hours without spraying: 5.6%

| chemical solution | amount [%] of moisture in sheet | | |
|---|---|---|---|
| | immediately after spraying | 1 hour later | 24 hours later |
| 50% solution of choline chloride | 10 | 6.8 | 6.6 |
| | 8.5 | 6.2 | 6.2 |

As can be seen from Table 2, the amount of moisture in each sheet 103 measured 24 hours after the spraying of the aqueous solution 109 containing a deliquescent material onto the sheet 103 is larger than the amount of moisture in each sheet 103 to which the aqueous solution 109 is not applied. It can also be seen from the table that the deliquescent material keeps moisture in the sheets 103.

As a surfactant is mixed into the aqueous solution 109, the permeability of the aqueous solution 109 with respect to the sheets 103 becomes higher. As a result, the aqueous solution 109 easily penetrates into the fiber of paper of the sheets 103. The effect to break the hydrogen bonding in the fiber of paper and dissolve cellulose is then increased. Accordingly, wavelike distortions or curling of the sheets 103 can be reduced. If only the aqueous solution 109 is sprayed, water droplets remain on the surfaces of the sheets 103, and the sheets 103 stick to one another when a large number of sheets 103 are stacked. However, by mixing a surfactant into the aqueous solution 109, the permeability is made higher, and the water droplets on the surfaces of the sheets 103 are rapidly absorbed into the sheets 103. In this manner, the stacking characteristics of the sheets 103 are improved. Acetylene glycol, which is a non-ionic surfactant, was used as the surfactant to be mixed into the aqueous solution 109.

Figure 3B:
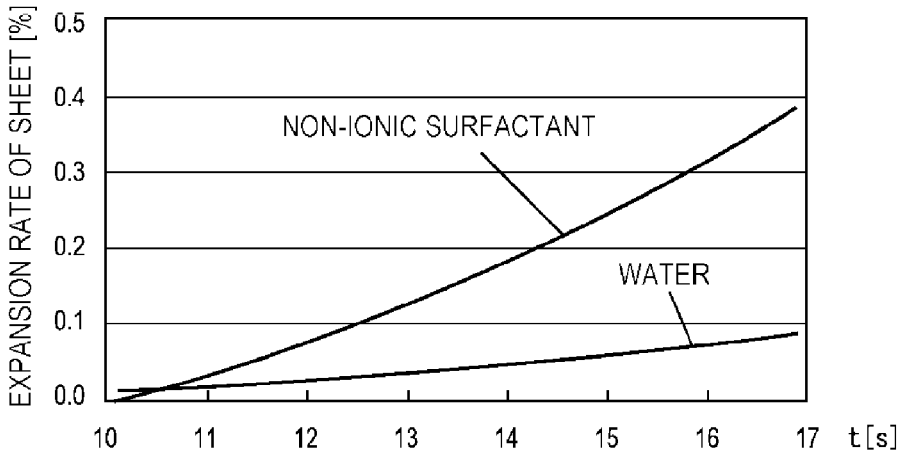
FIG. 3B is a graph illustrating a comparison in sheet expansion rate between an aqueous solution containing a surfactant and water.

FIG. 3B illustrates the results of measurements of expansion and contraction of a sheet 103 to which the aqueous solution 109 containing 1% of a surfactant was applied and a sheet 103 to which only water was applied. The sheets 103 expand after absorbing moisture. Therefore, the permeability can be determined to be high when the expansion rate is high. As can be seen from FIG. 3B, the permeability of the aqueous solution 109 containing a surfactant is higher than the permeability of water.

With the use of the injection nozzles 107*a* and 107*b* of the aqueous solution applying portion 2, an aqueous solution 109 containing a deliquescent material was sprayed on each sheet 103 having just passed through the fixing device 1. The heights of wavelike distortions of the sheets 103 were then measured. The heights of wavelike distortions of sheets 103 were measured, where twenty sheets 103 were stacked. The heights of wavelike distortions of the sheets 103 were measured immediately after the spraying and forty-eight hours after the spraying, and the variations of the heights of the wavelike distortions were observed. The temperature in the surroundings was approximately 23° C., and the humidity was approximately 40%. Here, the temperature of the fixing rotating member 101 of the fixing device 1 was 170° C., and the rotation speed was 300 mm/sec. The temperature of the pressurizing rotating member 102 was 100° C., and the rotation speed was 300 mm/sec. Accordingly, the speed of each sheet 103 passing through the injection nozzles 107*a* and 107*b* of the aqueous solution applying portion 2 was 300 mm/sec. The aqueous solutions 109 sprayed onto the sheets 103 were a 50% solution of choline chloride having deliquescent properties, and a 50% solution of N-methylmorpholine-N-oxide (MMNO) having deliquescent properties and the function to break hydrogen bonding in the fiber of paper. N-methylmorpholine-N-oxide (MMNO) as a deliquescent material belongs to the group of compounds containing amine oxides. Table 3 shows the results of the above measurements.

TABLE 3

| chemical solution | concentration [%] | amount [%] of moisture immediately after spraying | elapsed time [h] | height of wavelike distortions [mm] |
|---|---|---|---|---|
| without spraying | none | 4.4 (without spraying) | 0 | 4.5 |
| | | 5.5 | 48 | 3.5 |
| choline chloride | 50 | 7.7 | 0 | 1.6 |
| | | 6.0 | 48 | 2.2 |
| N-methylmorpholine-N-oxide | 50 | 6.5 | 0 | 1.0 |
| | | 5.8 | 48 | 0.3 |

As can be seen from Table 3, wavelike distortions of the sheets 103 were made smaller by spraying the aqueous solution 109 onto the sheets 103, and the wavelike distortions of the sheets 103 were maintained in the reduced state even forty-eight hours after the spraying. Where moisture is not sprayed, each sheet 103 has a moisture amount of 4.4% immediately after passing through the fixing device 1. Where each sheet 103 is left forty-eight hours after passing through the fixing device 1, each sheet 103 has a moisture amount of 5.5%. Where the 50% solution of choline chloride was sprayed onto the sheets 103, the amount of moisture in the sheets 103 immediately after the spraying was 7.7%, and the amount of moisture in the sheets 103 forty-eight hours after the spraying was 6.0%. Where the 50% solution of N-methylmorpholine-N-oxide was sprayed onto the sheets 103, the amount of moisture in the sheets 103 immediately after the spraying was 6.5%, and the amount of moisture in the sheets 103 forty-eight hours after the spraying was 5.8%. As can be seen from the above, where an aqueous solution 109 containing a deliquescent material was sprayed, the amount of moisture can be retained in the sheets 103, and the heights of wavelike distortions of the sheets 103 were made smaller. Furthermore, an aqueous solution 109 containing a deliquescent material having the function to break hydrogen bonding in the fiber of paper and dissolve cellulose is particularly effective in reducing the heights of wavelike distortions of the sheets 103.

As a deliquescent material, N-ethylmorpholine-N-oxide (EMNO) also has the same effect as the effect of N-methylmorpholine-N-oxide (MMNO) to reduce wavelike distortions and curling of the sheets 103. Also, the group of compounds containing amines also include materials having deliquescent properties. Examples of such materials include L-carnitine, N-methylglycine, BtEAC (benzyltriethylammonium chloride), N-methylmorpholine-N-oxide (MMNO), and BtMAC (benzyltrimethylammonium chloride). Further examples of such materials include choline chloride, acetamide ethanol, thiamine hydrochloride, and pyrazole. Here, amines are materials in which one or more hydrogen atoms of ammonia are replaced by a hydrocarbon group.

Through the above experiments, it was confirmed that the addition of an aqueous solution 109 containing a deliquescent material to the sheets 103 was effective in reducing wavelike distortions and curling of the sheets 103.

Where an aqueous solution 109 was sprayed with the use of the aqueous solution applying portion 2 illustrated in FIG. 2 onto each sheet 103 yet to pass through the fixing device 1, and the fixing device 1 applies heat and pressure to each sheet 103 after the spraying, it was confirmed that wavelike distortions and curling of the sheets 103 were also made smaller.

A solution containing a nonvolatile substance that forms hydrogen bonding with the fiber of paper, instead of moisture, and restrains hydrogen bonding in the fiber is applied to each sheet 103. The solution then penetrates into the fiber, and prevents hydrogen bonding in the fiber, though the sheet 103 is dry. Accordingly, the reduction of wavelike distortions or curling of the sheets 103 can be continued.

As a surfactant is mixed into an aqueous solution 109, the permeability becomes higher. As a result, the aqueous solution 109 easily penetrates into the fiber of paper, and the effect to break the hydrogen bonding in the fiber of paper and dissolve cellulose is increased. Accordingly, wavelike distortions or curling of the sheets 103 can be made smaller. If only water is applied, the permeability in the sheets 103 is low, and water droplets remain on the surfaces of the sheets 103. As a result, the sheets 103 stick to one another where a large number of sheets 103 are stacked. However, by mixing a surfactant into the aqueous solution 109, the permeability in the sheets 103 is made higher, and stacking characteristics of the sheets 103 are improved.

The invention claimed is:

1. An image forming apparatus comprising:

an image forming unit which forms a toner image on a sheet;

a fixing unit which thermally fixes a toner image onto a sheet; and an aqueous solution applying unit which applies an aqueous solution to the sheet, the aqueous solution applying unit applies the aqueous solution containing a deliquescent material which prevents moisture evaporation to a sheet having a toner image thermally fixed thereonto by a fixing unit.

2. The image forming apparatus according to claim 1, wherein the deliquescent material belongs to the group of compounds containing amine oxides.

3. The image forming apparatus according to claim 2, wherein, when the sheet is a paper sheet, the deliquescent material has a function to break hydrogen bonding in the fiber of paper and dissolve cellulose, and at least one substance in the deliquescent material is a solution containing N-methylmorpholine-N-oxide (MMNO) or N-ethylmorpholine-N-oxide (EMNO).

4. The image forming apparatus according to claim 1, wherein the deliquescent material belongs to the group of compounds containing amines.

5. The image forming apparatus according to claim 4, wherein at least one substance in the deliquescent material is a solution containing choline chloride.

6. The image forming apparatus according to claim 1, wherein the aqueous solution contains a surfactant.

7. The image forming apparatus according to claim 1, wherein the aqueous solution applying unit is provided on front and back surface sides of the sheet, and the aqueous solution is applied to both surfaces or one of the surfaces of the sheet by the aqueous solution applying unit.

8. The image forming apparatus according to claim 7, wherein the aqueous solution applying unit includes an injection nozzle or a waterjet mechanism.

9. The image forming apparatus according to claim 1, wherein the aqueous solution containing the deliquescent material is applied to the sheet, before the thermally fixed sheet is dried, and the amount of moisture in the sheet again becomes equivalent to the amount of moisture in a surrounding area.

10. The image forming apparatus according to claim 9, wherein the aqueous solution applying unit applies an aqueous solution containing a deliquescent material to the sheet in a sheet conveying path, after the sheet passes through the fixing unit, and the toner image is fixed onto the sheet.

* * * * *